US005271496A

United States Patent [19]

Cain

[11] Patent Number: 5,271,496

[45] Date of Patent: Dec. 21, 1993

[54] COMMUNION APPARATUS

[76] Inventor: Eunice F. Cain, 520 Himes Dr., Euless, Tex. 76039

[21] Appl. No.: 960,734

[22] Filed: Oct. 14, 1992

[51] Int. Cl.[5] ..... B65D 21/00

[52] U.S. Cl. ..... 206/217; 206/19; 206/563

[58] Field of Search ..... 206/197-203, 206/427, 562-565, 573, 139, 19, 217, 541, 545

[56] References Cited

U.S. PATENT DOCUMENTS

| | | | |
|---|---|---|---|
| 97,049 | 11/1889 | Clough . | |
| 539,264 | 5/1895 | Hall . | |
| 553,846 | 2/1896 | Forbes | 206/201 |
| 982,351 | 1/1911 | Cree et al. . | |
| 1,199,987 | 10/1916 | Husted . | |
| 1,575,972 | 3/1926 | Cochran . | |
| 2,597,336 | 5/1952 | Kemper . | |
| 2,711,089 | 6/1955 | Dingeldein | 206/565 |
| 2,851,154 | 9/1958 | Dingeldein | 206/562 |
| 3,390,766 | 7/1968 | Stockdale | 206/427 |
| 3,390,783 | 7/1968 | Quackenbush, Jr. | 206/562 |
| 3,514,029 | 5/1970 | Powell . | |
| 4,733,797 | 3/1988 | Haber . | |
| 4,905,866 | 3/1990 | Bartell et al. . | |
| 4,923,702 | 5/1990 | Powell . | |

FOREIGN PATENT DOCUMENTS

| | | | |
|---|---|---|---|
| 0001938 | of 1909 | United Kingdom | 206/563 |
| 0015983 | of 1914 | United Kingdom | 206/563 |

*Primary Examiner*—Jimmy G. Foster
*Attorney, Agent, or Firm*—Arthur F. Zobal

[57] ABSTRACT

The two communion devices for wine and bread each include a tray having a central opening for receiving a removable container and a plurality of cup receiving openings surrounding the central opening for receiving a plurality of cups. The container is located in the central opening for receiving the cups after they have been used. Each cup has an upper open end and a handle. In the embodiment for taking wine, or a suitable liquid, the cup receiving openings are formed in the top wall and the cups have lids. In the embodiment for taking bread, the cup receiving openings are formed in the side walls of the device leading to a cup receiving chamber or cavities with a bread receiving chamber located above the cup receiving chamber or cavities separated by an intermediate wall. Pairs of aligned openings are formed through the top wall and through the intermediate wall whereby a punch may be inserted through the aligned openings to sever and force the bread into the cups below the bread.

11 Claims, 4 Drawing Sheets

Fig.5
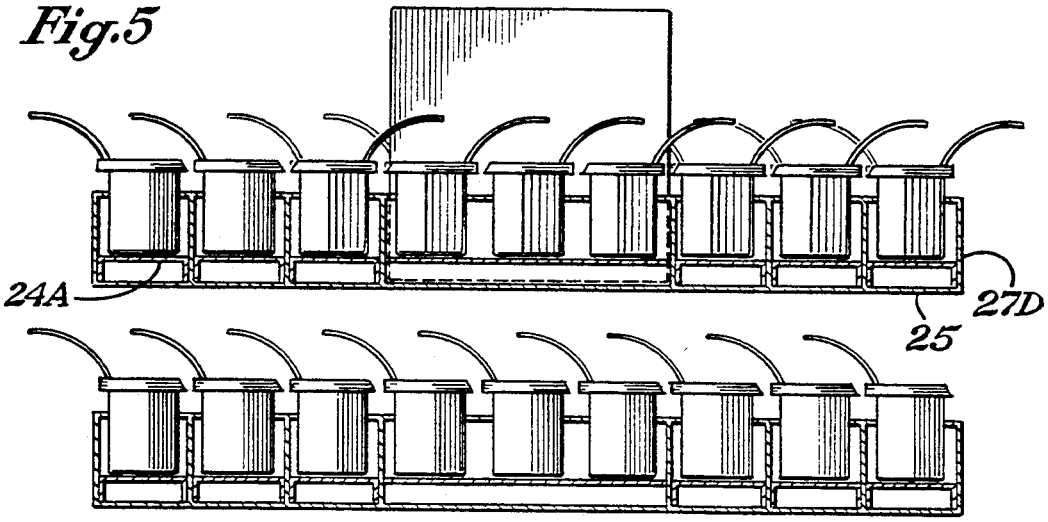
Fig.6
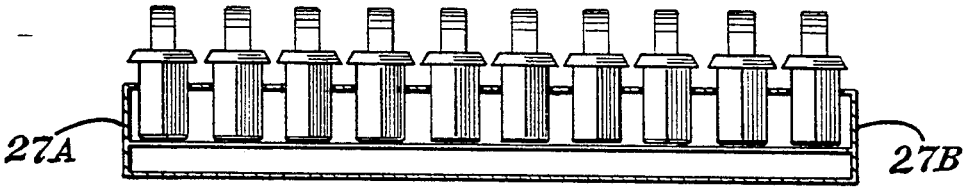
Fig.7
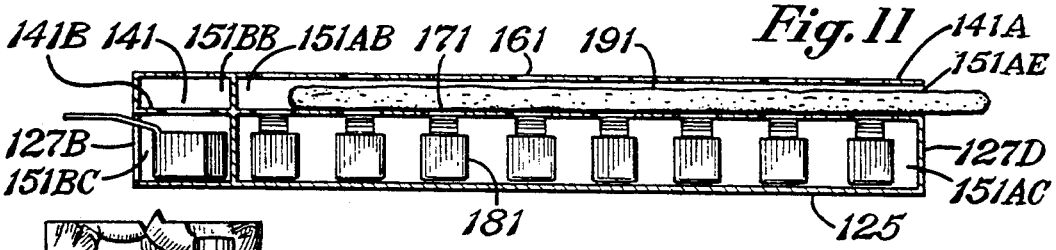
Fig.11
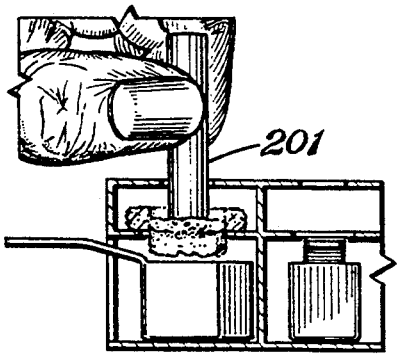
Fig.12
Fig.13
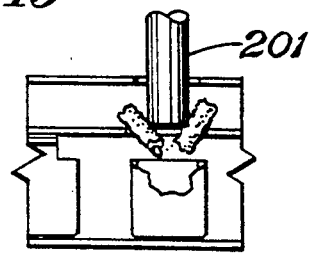

COMMUNION APPARATUS

BACKGROUND OF THE INVENTION

1. Field of the Invention

The invention relates to communion devices for wine and bread.

2. Description of the Prior Art

The conventional devices for allowing one to take communion in church are a tray for holding individual glasses for wine or juice and a tray for holding small pieces of bread. In using both devices much handling is required which enhances the transfer of diseases from one person to another. For example, the wine tray has a plurality of openings for holding open wine glasses which are close enough together such that one removing a glass can easily touch another adjacent glass. Moreover the glasses are washed and used again which can still result in transfer of disease if the washing is done improperly.

The bread tray generally used allows the bread pieces to be stacked on each other resulting in a person removing a bread piece also touching other bread pieces.

SUMMARY OF THE INVENTION

It is an object of the invention to provide a communion device which minimizes the handling of the wine glasses and eliminates their reuse and a communion device which minimizes the handling of the bread.

The communion device, comprises a tray having a central opening with container support means for receiving a removable container and a plurality of cup receiving openings with cup support means for receiving a plurality of cups. A plurality of cups are removably supported by the cup support means of the plurality of cup receiving openings, respectively. A container is removably supported by the container support means of the central opening for receiving the cups after they have been used whereby the container with the cups therein may be disposed of.

For use for holding liquid, each of the cups has a handle, an upper open end and a lid that can open and close the upper open end.

The device for holding bread comprises a tray having a top wall, a bottom wall, and a side wall with the central opening being formed in the top wall. An intermediate wall is formed between the top wall and the bottom wall defining a bread receiving chamber between the top wall and the intermediate wall. The plurality of cup receiving openings are formed in the side wall between the bottom wall and the intermediate wall. An entrance is formed though the side wall for allowing a length of bread to be located in the bread receiving chamber. A plurality of pairs of openings are formed through the upper wall and the intermediate wall respectively. Each of the pairs of openings comprises an upper wall opening formed through the upper wall and an intermediate wall opening formed through the intermediate wall in alignment with each other whereby a punch device may be inserted through the upper wall opening for punching a portion of the length of bread, when located in the bread receiving chamber, through the aligned intermediate wall opening for insertion into the cup located below the pair of openings.

In a further aspect, each of the cups has a handle that extends out of the cup receiving openings when the cups are located in the cup receiving openings.

BRIEF DESCRIPTION OF THE DRAWINGS

FIG. 5 is a cross-section of the tray of FIG. 1 taken through lines 5—5 thereof.

FIG. 6 is a cross-section of the tray of FIG. 1 taken through a plane on the side of the tray opposite that of the plane 5—5.

FIG. 7 is a cross-section of the tray of FIG. 1 taken through a plane transverse to plane 5—5.

FIG. 11 is a cross-section of the tray of FIG. 8 taken through lines 11—11 thereof.

FIG. 12 and 13 illustrates the bread in the tray of FIG. 8 being punched into a cup.

DESCRIPTION OF THE PREFERRED EMBODIMENTS

Figure 1:
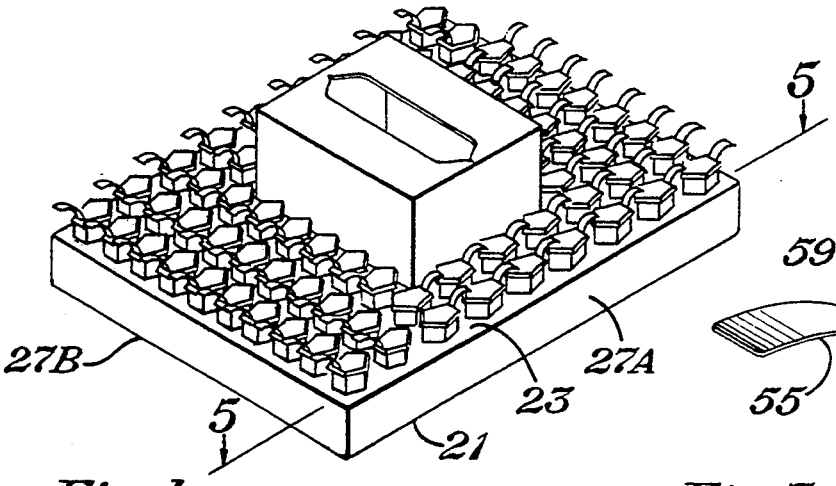
FIG. 1 illustrates one embodiment of the communion device of the invention with cups for holding wine or other suitable liquid.
Figure 3:
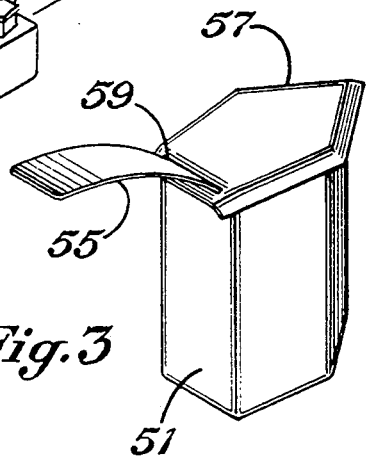
FIG. 3 illustrates one of the cups of FIG. 1 with its lid in a closed position.
Figure 2:
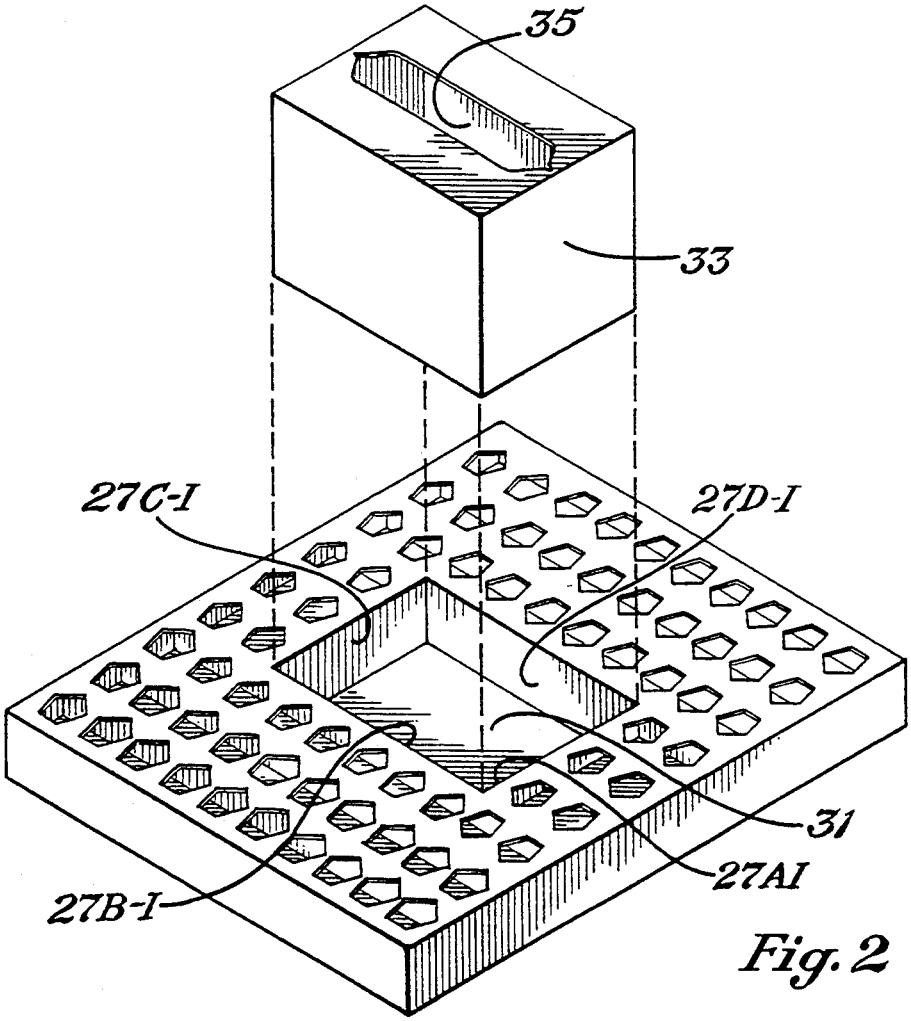
FIG. 2 illustrates the tray of the device of FIG. 1 with the central container removed.
Figure 8:
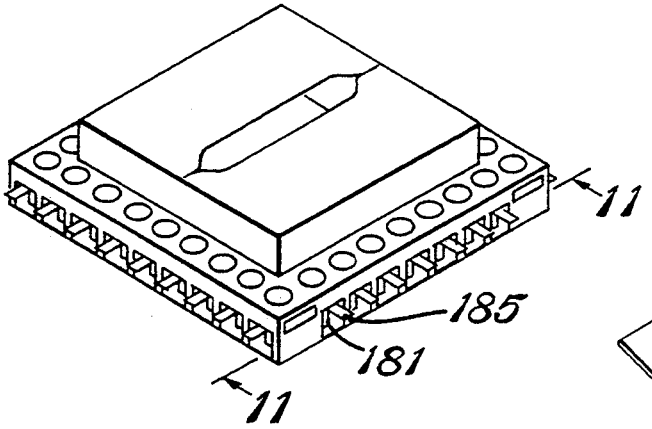
FIG. 8 illustrates another embodiment of the invention with cups for receiving bread.
Figure 4:
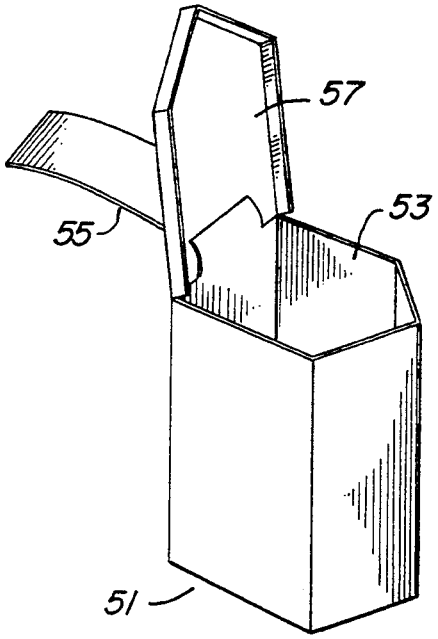
FIG. 4 illustrates the cup of FIG. 3 with its lid in an open position.

Referring now to FIGS. 1-7 there will be described the embodiment for holding and allowing one to take wine or other suitable liquid for communion purposes. The embodiment comprises a tray 21 having a top wall 23, a bottom wall 25 and four side walls 27A, 27B, 27C, and 27D. A central opening or cavity 31 is formed in the top wall 23 for holding a removable container 33 having an opening 35. The central opening 31 is formed by four interior walls 27A-I, 27B-I, 27C-I, and 27D-I which extend downward from the top wall 23 to the bottom wall 25 which supports the container 33. A plurality of cup receiving openings or cavities 41 are formed in the top wall 23 surrounding the central opening 31 for holding removable cups 51 for holding wine or other suitable liquid for communion purposes. The cups are supported by intermediate wall portions 24A. Each of the cups 51 has an upper opening 53 with a handle 55 extending from one edge thereof and a lid 57 for opening and closing the opening 53. The lid 57 has a slit 59 through which the handle 55 is inserted such that the lid 57 can pivot on the handle 55 from a closed position as shown in FIG. 3 to an open position as shown in FIG. 4. The cup 51 including the lid 57 and the handle 57 are formed of a flexible plastic such that the top side of the lid 57 can be moved against the top side of the handle 57 and both used as a handle.

In use, the cups are filled with a suitable liquid for communion purposes; their lids are closed; and they are inserted into the openings 41. The container also is inserted into the opening 31. The completed tray 21 then is passed to the persons taking communion. Each person may remove a cup 51 by grasping its handle 51 and then move the lid 57 to an open position; drink the liquid; and place the cup in the container 33 by way of the opening 35. In the alternative, a person may move the lid 57 back against the handle 51 and grasp both the handle 55 and the lid 57 to remove the cup from its opening 41. In either case, since the other cups all have their lids in a closed position, the person removing a cup cannot touch the upper edge of an adjacent cup surrounding its upper opening 53, thereby minimizing the transfer of germs or disease to the other persons who will take communion.

After all of the person have removed their cups; drunk the liquid therein; and inserted the cups into the container 33; the container 33 with the cups therein is disposed of; thereby further minimizing the transfer of germs or disease to other persons. The tray 21 may be washed and reused.

The tray 21 and the container 33 may be formed of a suitable plastic or even a suitable cardboard whereby both the tray 21 and the container 33 with the used cups in the container 33 may be disposed of.

Referring now to FIGS. 8–15, there will be described the embodiment for holding and allowing dispensing of bread for communion purposes. The embodiment comprises a tray 121 having a top wall 123, a bottom wall 125 and four side walls 127A, 127B, 127C, and 127D. A central opening 131 is formed in the top wall 123 for holding a removable container 133 having an opening 135. The central opening 131 is formed by interior four walls 127A–I, 127B–I, 127C–I, and 127D–I which extend down to the bottom wall 125 which supports the container 133.

Located between the interior walls 127A–I, 127B–I, 127C–I, and 127D–I and the exterior walls 127A, 127B, 127C, and 127D respectively are intermediate walls dividing the space between the top and bottom walls and each of the walls 127A and 127A–I; 127B and 127B–I; 127C and 127C–I; and 127D and 127D–I into upper bread receiving chambers and cup receiving chambers. In FIG. 11, two intermediate walls 141A and 141B are shown. Wall 141A divides the space between the top and bottom wall and walls 127A and 127A–I into an elongated bread receiving chamber 151AB having an entrance opening 151AE formed through wall 127D and a cup receiving chamber 151AC having cup receiving openings 127AC formed through wall 127A. Wall 141B divides the space between the top and bottom walls and walls 127B and 127B–I into an elongated bread receiving chamber 151BB having an entrance opening 151BE formed through wall 127A and a cup receiving chamber 151BC having cup receiving openings 127BC formed through wall 127B. The entrance for the upper bread receiving chamber formed between walls 127C and 127C–I is formed through wall 127B and the cup receiving openings for the lower cup receiving chamber are formed through wall 127C. The entrance for the upper bread receiving chamber formed between walls 127D and 127D–I is formed through wall 127C and the cup receiving openings for the lower cup receiving chamber are formed through wall 127D.

Formed through the top wall 123 are a plurality of punch receiving apertures 161. Each aperture 161 is next to an adjacent cup receiving opening formed through the adjacent side wall 127A, 127B, 127C, and 127D. Formed through each of the intermediate walls including walls 141A and 141B are a plurality of apertures 171. Each aperture 171 is in alignment with an aperture 161.

Figure 10:
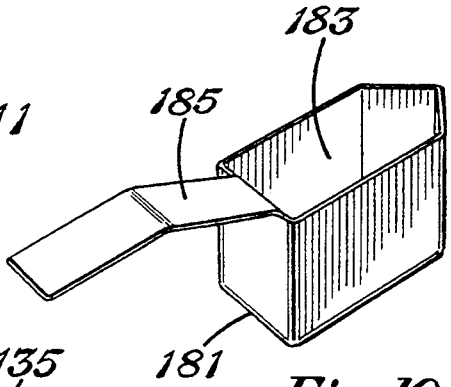
FIG. 10 illustrates one of the cups used in the device of FIG. 5.
Figure 9:
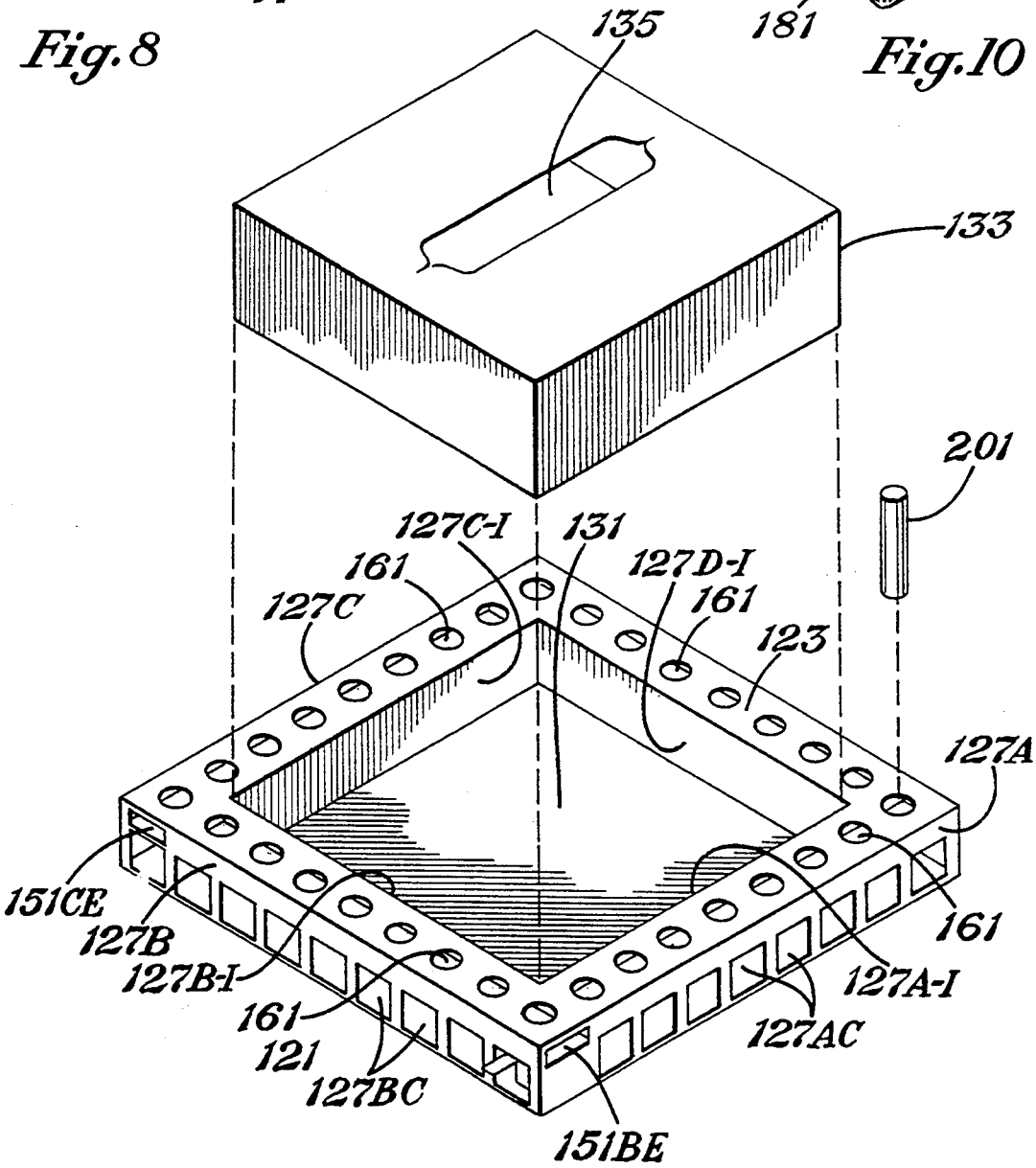
FIG. 9 illustrates the tray of the device of FIG. 8 with the central container removed.

One of the cups used in the embodiment of FIGS. 8–15 is shown at 181 in FIG. 10. It has an upper opening 183 with a handle 185 extending from one of the edges thereof.

Figure 15:
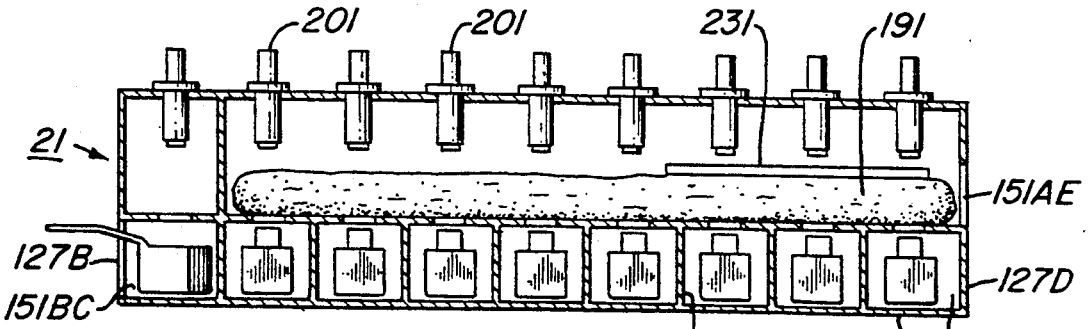
FIG. 15 illustrates punches of the type of FIG. 14 installed onto a tray.

The bread used is shown at 191 in FIG. 11. It comprises an elongated piece of bread or loaf which can be located in one of the bread receiving chambers by way of its entrance. Three entrances are shown at 151AE, 151BE, and 151CE. Four bread loaves will be located in the four bread receiving chambers by way of their entrances such that the loaves of bread are located below the openings 161 and above the openings 171. For example a bread loaf 191 will be located in the bread receiving chamber 151AB by way of entrance 151AE and a bread loaf 191 will be located in the bread receiving chamber 151BB by way of the entrance 151BE. Cups 181 will be located in all of the cup receiving chambers by way of the cup receiving openings formed through the four walls 127A, 127B, 127C, and 127D such that each cup is supported by the bottom wall 125 below an opening 171 with its handle extending outward. For example cups 181 will be located in the chamber 151AC by way of the openings 127AC and cups 181 will be located in the chamber 151BC by way of the openings 127BC. Thus each cup will have its own opening space or cavity below each opening 171. In order to prevent the cups from sliding in the cup receiving chambers, walls 151W may extend between the intermediate walls and the bottom wall as shown in FIG. 15 to isolate each cup receiving opening or cavity below the opening 171.

A punch 201 is used to punch a portion of the bread loaves into the cups 181. Preferably the bread loaves will be crisp, made from unleavened bread. For inserting a bread portion into a given cup, the punch 201 is inserted through the opening 161 above the cup and pressed against the bread loaf below the opening 161 to sever or break a portion of the bread and force it through the lower opening 171 into the cup below the opening. The user then removes the cup to take the bread and inserts the cup into the container 133. This is done sequentially for each person taking bread. The container 133 with the used cups is disposed of and the tray 121 washed for reuse or it may be disposed of also.

Thus after installation of the bread loaves in the bread chambers, the bread loaves will be untouched by the person taking the bread thereby minimizing the transfer of germs and disease from one person to another.

The tray 121 and cups 181 maybe formed of a suitable plastic.

Figure 14:
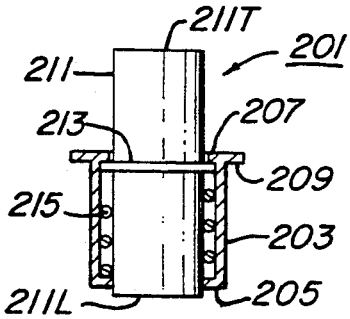
FIG. 14 is a cross-section of a preferred punch.

Referring to FIG. 14 the punch 201 used may comprises an outer cylindrical tubular member 203 having inward extending lips 205 and 207 and an outward extending flange 209 with a solid cylindrical rod 211 located within the tubular member 203. The rod 211 has a circular outer rim 213 secured thereto. A metal coil spring 215 is located around the rod 211 and has one end seated against the lip 205 and an opposite end seated against the rim 213 for urging the rod in the upper position shown. The member 203 is inserted into one of the openings 161 until the flange 209 engages the top 123 of the tray as shown in FIG. 15. In this embodiment the bread receiving chamber is higher than that of FIG. 11. One can use the punch by pushing downward on the top end 211T of the rod 211 moving its lower end 211L downward against the bread 191 to cut and break the bread and to push it down through the lower opening 171 into the lower cup. When the rod 211 is released, the spring 213 will move the rod upward whereby the cup with the bread can be removed.

The punch 201 can then be inserted into the next opening 161 for use, however, preferably each opening 161 will have a punch 201 permanently installed therein as shown in FIG. 15. Members 203 and 211 of the punch may be formed of suitable metal.

Figure 16:
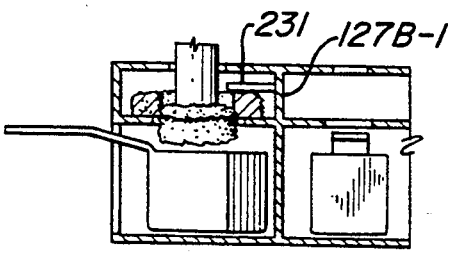
FIG. 16 is a cross-section of a bread chamber illustrating a spring member for holding the bread in place.

In FIGS. 15 and 16 there is shown a spring member 231 secured to the wall 127B–I and which extends partially along the length of the bread chamber 151AB and inwardly a short distance so as not to impede use of the punch. The purpose of the member 231 is to allow the bread loaf 191 to be slid in the bread chamber 151AB from the entrance to the other end and to apply pressure to the bread against the wall 141A to hold the bread in place as it is punched through the openings 171 into the cups. Members similar to member 231 will be used in the other bread chambers for the same purpose.

Figure 18:
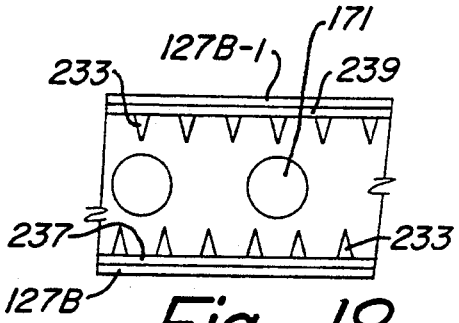
FIG. 18 is a cross-section of a bread chamber looking down and showing flexible comb-like members for holding the bread in place.
Figure 17:
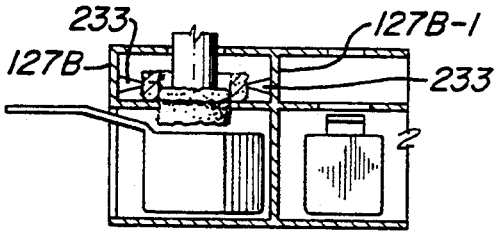
FIG. 17 is a view similar to that of FIG. 16 but showing flexible comb-like members for holding the bread in place.

In the embodiment of FIG. 17 and 18 flexible cone shaped members 233 are secured to the inside of walls 127B and 127B–I or to walls 237 and 239 secured to the walls 127B and 127B–I to allow the bread loaf to be slid into the bread chamber but to apply pressure to the sides of the bread loaf to hold it in place as it is punched through the openings 171 into the cups.

Flexible cone shaped members 233 will be secured to the side walls of the other bread chambers for the same purpose.

Although not shown, slidable or pivotal doors may be employed to open and close the entrances, i.e. entrances 151AE, 151BE, 151CE to the bread chambers.

I claim:

1. A communion device, comprising:

a tray having a single large central opening with container support means for receiving a removable container and a plurality of cup receiving openings with cup support means surrounding said central opening for receiving a plurality of cups, a plurality of cups to be removably supported by said cup support means of said plurality of cup receiving openings, respectively, and a container to be removably supported by said container support means of said central opening for receiving said cups after they have been used whereby said container with said cups therein may be disposed of, said container having two transverse dimensions each of which is much larger than that of any of said cups forming a cross-sectional area much larger than that of any of said cups and having a height greater than that of any of said cups.

2. The communion device of claim 1, wherein:

said tray has a top wall, a bottom wall, and a side wall, said central opening being formed in said top wall and said plurality of cup openings being formed in said top wall in a pattern that surrounds said central opening.

3. The communion device of claim 1, wherein:

each of said cups has a handle, an upper open end and a lid that can open and close said upper open end.

4. The communion device of claim 2, wherein:

each of said cups has a handle, an upper open end, and a lid that can open and close said upper open end.

5. A communication device, comprising:

a tray having a central opening with container support means for receiving a removable container and a plurality of cup receiving openings with cup support means surrounding said central opening for receiving a plurality of cups, a plurality of cups to be removable supported by said cup support means of said plurality of cup receiving openings, respectively, a container to be removably supported by said container support means of said central opening for receiving said cups after they have been used whereby said container with said cups therein may be disposed of, said tray has a top wall, a bottom wall, and side wall means, said central opening is formed in said top wall, an intermediate wall formed between said top wall and said bottom wall defining a bread receiving chamber between said top wall and said intermediate wall, said plurality of cup receiving openings are formed in said side wall means at a level between said bottom wall and said intermediate wall, an entrance formed through said side wall means for allowing a length of bread to be located in said bread receiving chamber, and a plurality of pairs of openings formed through said upper wall and said intermediate wall respectively, each of said pairs of openings comprising an upper wall opening formed through said upper wall and an intermediate wall opening formed through said intermediate wall in alignment with each other, and located above said cup support means, whereby a punch device may be inserted through said upper wall opening for punching a portion of said length of bread, when located in said bread receiving chamber, through said aligned intermediate wall opening for insertion into a cup supported by said cup support means.

6. The communion device of claim 5, wherein:

said side wall means comprises at least first and second side wall portions transverse to each other, said plurality of cup receiving openings are formed in said first side wall portion and said entrance is formed through said second side wall portion.

7. The communion device of claim 6, wherein:

each of said cups has a handle that extends out of said cup receiving openings when said cups are supported by said cup support means.

8. A communion device, comprising:

a tray having a central opening with container support means for receiving a removable container and a plurality of cup receiving openings with cup support means for receiving a plurality of cups, a plurality of cups to be removably supported by said cup support means of said plurality of cup receiving openings, respectively, a container to be removably supported by said container support means of said central opening for receiving said cups after they have been used whereby said container with said cups therein may be disposed of, said tray having a top wall, a bottom wall, and side wall means, said central opening being formed in said top wall, an intermediate wall formed between said top wall and said bottom wall defining a bread receiving chamber between said top wall and said intermediate wall, said plurality of cup receiving openings are formed in said side wall means at a level between said bottom wall and said intermediate wall, an entrance formed through said side wall means for allowing a length of bread to be located in said bread receiving chamber, and a plurality of pairs of openings formed through said upper wall and said intermediate wall respectively, each of said pairs of openings comprising an upper wall opening formed through said upper wall and an intermediate wall opening formed through said intermediate wall in alignment with each other and located above said cup support means, whereby a punch device may be inserted through said upper wall opening for punching a portion of said length of bread, when located in said bread receiving chamber, through said aligned intermediate wall opening for insertion into a cup supported by said cup support means.

9. The communion device of claim 8, wherein:

said side wall means comprises at least first and second side wall portions transverse to each other, said plurality of cup receiving openings are formed in said first side wall portion and said entrance is formed through said second side wall portion.

10. The communion device of claim 9, wherein:

each of said cups has a handle that extends out of said cup receiving openings when said cups are supported by said cup support means.

11. The communion device of claim 8, comprising:

a punch device located in each of said upper wall openings for use for punching a portion of said length of bread, when located in said bread receiving chamber, through said aligned intermediate wall opening for insertion into a cup supported by said cup support means.

* * * * *